US007255341B2

(12) United States Patent
Yoshioka et al.

(10) Patent No.: US 7,255,341 B2
(45) Date of Patent: Aug. 14, 2007

(54) SHEET HANDLING APPARATUS

(75) Inventors: Kazuei Yoshioka, Tokyo (JP); Jun Fujimoto, Tokyo (JP)

(73) Assignee: Aruze Corp., Tokyo (JP)

( * ) Notice: Subject to any disclaimer, the term of this patent is extended or adjusted under 35 U.S.C. 154(b) by 393 days.

(21) Appl. No.: 10/829,277

(22) Filed: Apr. 22, 2004

(65) Prior Publication Data

US 2004/0212143 A1 Oct. 28, 2004

(30) Foreign Application Priority Data

Apr. 23, 2003 (JP) ..... 2003-118203

(51) Int. Cl.
*B65H 29/38* (2006.01)

(52) U.S. Cl. ..... 271/177; 271/180; 271/181

(58) Field of Classification Search ..... 271/177, 271/180, 181; 194/206
See application file for complete search history.

(56) References Cited

U.S. PATENT DOCUMENTS 4,809,966 A 3/1989 Kobayashi et al.
5,286,017 A * 2/1994 Hawk et al. ..... 271/303
5,372,361 A 12/1994 Isobe et al.
5,419,423 A * 5/1995 Ishida et al. ..... 194/206
5,421,443 A 6/1995 Hatamachi et al.
5,639,081 A 6/1997 Hatamachi et al.
5,676,366 A * 10/1997 Polidoro ..... 271/176
5,899,452 A * 5/1999 Walsh ..... 271/180
6,948,607 B2 * 9/2005 Ito et al. ..... 194/206
2002/0060404 A1 * 5/2002 Ono et al. ..... 271/177
2003/0127790 A1 * 7/2003 Chou ..... 271/177
2003/0137095 A1 * 7/2003 Ito et al. ..... 271/176

FOREIGN PATENT DOCUMENTS

EP 0762344 A1 3/1997
JP 08-123991 A1 5/1996

OTHER PUBLICATIONS

European Search Report Dated Jul. 28, 2004.

* cited by examiner

*Primary Examiner*—David H. Bollinger
(74) *Attorney, Agent, or Firm*—Rader, Fishman & Grauer PLLC

(57) ABSTRACT

In the bill handling apparatus 100, there are provided the bill validating unit 10 which judges whether the bill received from outside is valid or not, the stacker 1 which is detachable with the main unit 2 and receives the bill judged as valid by the bill validating unit 10, the bill feed unit 30 which feeds the bill from the bill validating unit 10 in the length direction of the bill and the bill guide part 4 which temporarily holds the bill discharged from the bill feed unit 30. When the force P is exerted to the press force receiving plate 43, the push-in late 40 is contacted to the bill by the parallel crank mechanism 4P, thereby the bill is moved toward the bill support plate 50, thereafter the bill is stacked in the bill piling part 5 between the partition walls 4A, 4B and the bill support plate 50.

11 Claims, 14 Drawing Sheets

SHEET HANDLING APPARATUS

CROSS-REFERENCE TO THE RELATED APPLICATION

This application is based upon and claims a priority from the prior Japanese Patent Application No. 2003-118203 filed on Apr. 23, 2003, the entire contents of which are incorporated herein by reference.

BACKGROUND OF THE INVENTION

1. Field of the Invention

The present invention relates to a paper sheet handling apparatus which can handle paper sheets such as bills and the like. Here, as paper sheets which are handled in the paper sheet handling apparatus according to the present invention, there will be conceivable bills. And the paper sheet handling apparatus can be applied to gaming machines such as Japanese Pachinko machines, slot machines or vending machines (abbreviated as "gaming machines and the like" hereinafter).

2. Description of Related Art

Conventionally, it is known a bill handling apparatus, installed in the gaming machines and the like, which are provided with a bill validating unit for validating whether bills inserted through a bill insertion slot is valid or not and a bill receiving unit (abbreviated as "stacker" hereinafter) for receiving bills fed by the bill validating unit after determined that bills are valid.

In the above bill handling apparatus, the stacker can be easily detached from a main unit of the bill handling apparatus. And in a case that bills are fully stacked in the stacker, only the stacker is detached from the main unit and bills can be carried with the stacker.

As the above bill handling apparatus, it is proposed a bill handling apparatus in Japanese Unexamined Publication No. Hei 8-123991. In the bill handling apparatus, there are provided a bill validating unit for validating bills inserted from outside thereof, a main unit that a stacker receiving bills validated as normal by the bill validating unit can be attached thereto and detached therefrom, a bill feed unit for feeding bills from the bill validating unit to the stacker, a bill push-in unit for pushing and stacking bills in the stacker, a driving unit for driving the bill push-in unit and a lock and unlock device for locking or unlocking the stacker when the stacker is attached in the main unit. In the above bill handling apparatus, it is constructed so that the driving unit is installed in the main unit and the lock and unlock device is driven by driving force transmitted from the driving unit, thereby lock and unlock operation by the lock and unlock device is conducted.

However, in the above mentioned bill handling apparatus having the lock and unlock device, a mechanism (for example, the cam mechanism) for pushing bills, which are fed from the bill feed unit, in the stacker is attached to the stacker. Due to this, the stacker becomes heavier and bigger, as a result, it is very inconvenient to carry the stacker.

Further, conventionally, in order to surely carry bills fed from the bill validating unit into the stacker, it is necessary to add to the above bill feed unit a bill take-in mechanism which is constructed from a bill sending rollers or a slider and the like, and a drive source for driving the bill take-in mechanism.

SUMMARY OF THE INVENTION

The present invention is done taking the above situation into consideration, and the object of the present invention is to provide a sheet handling apparatus having a light sheet receiving unit with a small size which is detachably arranged in a main unit, thereby there is no need to arrange a specific sheet take-in device such as sheet sending rollers, based on that a push device, which comprises a simple link mechanism surely pushing sheets fed from a sheet feed device in the sheet receiving unit, is arranged in the sheet receiving unit, and a drive device for driving the link mechanism is arranged in the main unit.

In order to accomplish the above object, according to one aspect of the present invention, it is provided a sheet handling apparatus including:

a main unit;

a sheet validating device for determining whether a sheet received from outside is valid or not, the sheet validating device being provided in the main unit;

a sheet receiving unit which is detachable from the main unit;

a sheet feed device for feeding the sheet which is determined as valid by the sheet validating device to the sheet receiving unit;

a plurality of stopper walls disposed in the sheet receiving unit;

a sheet support plate slidably arranged in the sheet receiving unit, the sheet support plate having a sheet support plane which is urged toward at least one side of the stopper walls;

a sheet push plate arranged at the other side of the stopper walls so as to face the sheet support plane, the sheet push plate moving the sheet fed to the sheet receiving unit through the sheet feed device, toward the sheet support plane while pushing the sheet; and a push device for rotating the sheet push plate downward while retaining a parallel relation between a sheet push plane of the sheet push plate and the sheet support plane of the sheet support plate, thereby the sheet push plate draws and separates the sheet fed to the sheet receiving unit from the sheet feed device and pushes the sheet to the sheet support plane of the sheet support plate.

In the sheet handling apparatus, the sheet push plate is rotated downward while retaining a parallel relation between a sheet push plane of the sheet push plate and the sheet support plane of the sheet support plate. Thereby, the sheet push plate draws and separates the sheet fed to the sheet receiving unit from the sheet feed device and pushes the sheet to the sheet support plane of the sheet support plate.

As mentioned, in the sheet handling apparatus, the sheet push plate draws and separates the sheet from the sheet feed device and pushes the separated sheet to the sheet support plane while retaining a parallel relation between a sheet push plane of the sheet push plate and the sheet support plane of the sheet support plate. Thereby, there is no need to independently provide a mechanism for drawing and separating the sheet from the sheet feed device and a mechanism for parallel moving the sheet toward the sheet support plane of the sheet support plate. As a result, the sheet can be drawn and separated from the sheet feed device and can be surely moved to the sheet support plane of the sheet support plate, through the sheet push plate and the push device.

Further, even if the sheet fed to the sheet receiving unit through the sheet feed device does not fall in the sheet receiving unit by natural fall thereof, based on that the sheet push plate is rotated downward while retaining a parallel relation between a sheet push plane of the sheet push plate and the sheet support plane of the sheet support plate, thereby the sheet push plate can give a downward force to the sheet and can stack the sheet in the sheet receiving unit after reforming the sheet in a plain state.

As mentioned, in order to surely take the sheet fed from the sheet feed device into the sheet receiving unit, there is no need to provide a sheet take-in mechanism constructed from feed rollers and sliders and a drive source for driving the sheet take-in mechanism. Therefore, the sheet receiving unit can be simply constructed and cost thereof can be reduced.

Here, the sheet handled by the above sheet handling apparatus may be a bill, and further may be a card type paper sheet such as a gift certificate. And if the sheet is a bill or a gift certificate, the feeding direction may be corresponded to the length direction thereof.

And according to another aspect of the present invention, it is provided a sheet handling apparatus including:

a main unit;

a sheet validating device for determining whether a sheet received from outside is valid or not, the sheet validating device being provided in the main unit;

a sheet receiving unit which is detachable from the main unit;

a sheet feed device having a feed path to the sheet receiving unit and a plurality of roller pairs arranged at both sides of the feed path, the sheet feed device feeding the sheet which is determined as valid by the sheet validating device to the sheet receiving unit through the roller pairs;

a sheet support plate slidably arranged in the sheet receiving unit, the sheet support plate having a sheet support plane; and a sheet push plate arranged so as to face to the sheet support plane of the sheet support plate, the sheet push plate moving the sheet fed to the sheet receiving unit through the roller pairs in the sheet feed device, toward the sheet support plane while pushing the sheet;

wherein when a rear end of the sheet fed to the sheet receiving unit is held by a roller pair positioned in a final stage among the roller pairs, the sheet push plate draws and separates the rear end of the sheet from the roller pair in the final stage and pushes the sheet to the sheet support plane of the sheet support plate.

According to the above sheet handling apparatus, when a rear end of the sheet fed to the sheet receiving unit is held by a roller pair positioned in a final stage among the roller pairs, the sheet push plate draws and separates the rear end of the sheet from the roller pair in the final stage and pushes the sheet to the sheet support plane of the sheet support plate. Thereby, the sheet push plate draws and separates the sheet fed to the sheet receiving unit from the sheet feed device and pushes the sheet to the sheet support plane of the sheet support plate. As mentioned, in the sheet handling apparatus, the sheet push plate draws and separates the sheet from the sheet feed device and pushes the separated sheet to the sheet support plane, thereby there is no need to independently provide a mechanism for drawing and separating the sheet from the sheet feed device and a mechanism for parallel move the sheet toward the sheet support plane of the sheet support plate. As a result, the sheet can be drawn and separated from the sheet feed device and can be surely moved to the sheet support plane of the sheet support plate, through the sheet push plate and the push device.

As mentioned, in order to surely take the sheet fed from the sheet feed device into the sheet receiving unit, there is no need to provide a sheet take-in mechanism constructed from feed rollers and sliders and a drive source for driving the sheet take-in mechanism. Therefore, the sheet receiving unit can be simply constructed and cost thereof can be reduced.

The above and further objects and novel features of the invention will more fully appear from the following detailed description when the same is read in connection with the accompanying drawings. It is to be expressly understood, however, that the drawings are for purpose of illustration only and not intended as a definition of the limits of the invention.

BRIEF DESCRIPTION OF THE DRAWINGS

The accompanying drawings, which are incorporated in and constitute a part of this specification illustrate embodiments of the invention and, together with the description, serve to explain the objects, advantages and principles of the invention.

DETAILED DESCRIPTION OF THE PREFERRED EMBODIMENTS

Hereinafter, embodiments of the present invention will be explained according to the drawings. Here, in the embodiments mentioned hereinafter, description will be done based on that paper sheets handled in a paper sheet handling apparatus of the present invention is bills. Further, although description will be done according to the embodiment in which the present invention is applied to the gaming machines and the like, the present invention is not limited to this case. For example, the present invention can be applied to vending machines and the like.

Figure 1:
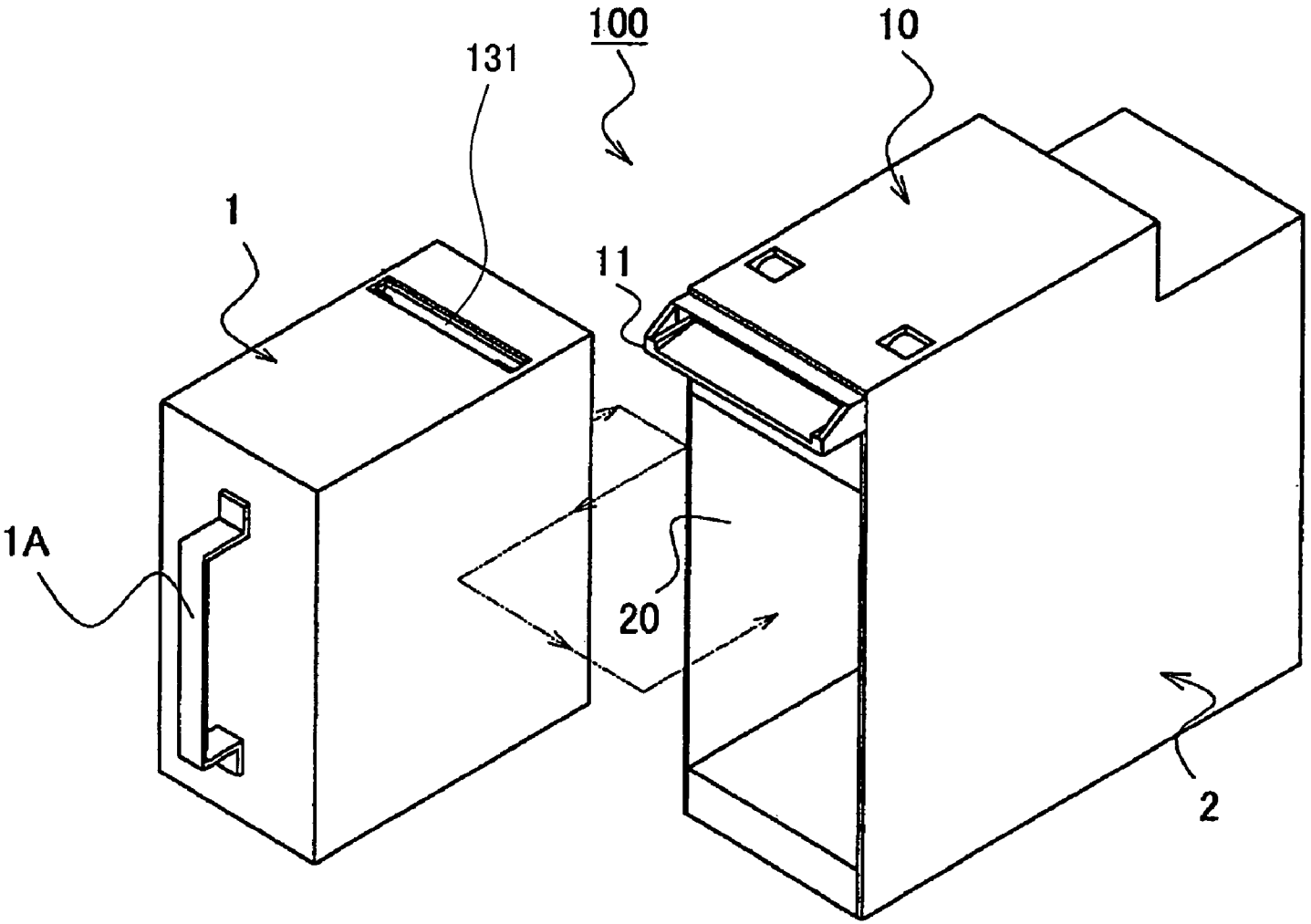
FIG. 1 is an outline view roughly showing a bill handling apparatus in the first embodiment according to the present invention.

FIG. 1 is an outline view roughly showing a bill handling apparatus in the first embodiment. In FIG. 1, a bill handling apparatus 100 is constructed from a bill validating unit 10 which operates as a bill validating device for validating whether bills received from outside thereof are valid or not, and a main unit 1 in which a bill receiving device 1 (abbreviated as "stacker 1" hereinafter), which receives many bills in a pile, is arranged. The stacker 1 is made detachable in the main unit 2 of the bill handling apparatus 100.

In FIG. 1, a handle 1A is fixed to the rear side of the stacker 1 formed in a box-like shape. The handle 1A is utilized when the stacker 1 is taken from the main unit 2 or when the stacker 1 is carried out. In the bill validating unit 10, a bill insertion slot 11 is formed at an entrance thereof. And under the bill insertion slot 11, an opening 20 for inserting the stacker 1 is formed in the main unit 2.

Figure 2:
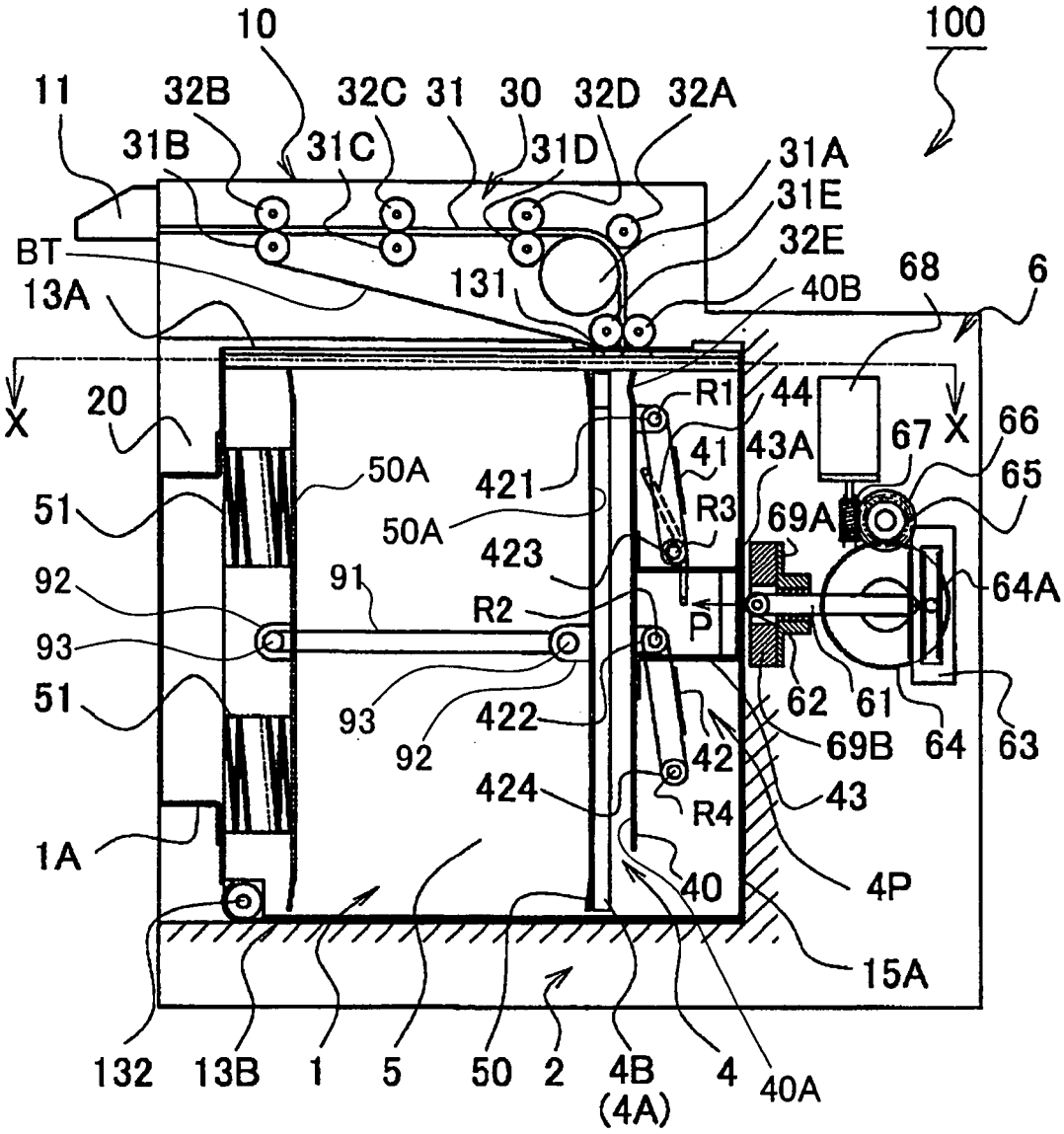
FIG. 2 is a longitudinal sectional view of the bill handling apparatus in the first embodiment according to the present invention.

FIG. 2 is a longitudinal sectional view of the bill handling apparatus in the first embodiment. With reference to FIG. 2, construction of the bill handling apparatus will be explained in detail.

In FIG. 2, it is judged in the bill validating unit 10 whether bills inserted from the bill insertion slot 11 are valid or not and good or not. Here, in the bill validating unit 10, bill data detected by the detector (not shown) installed therein are read in and the control unit comprising CPU and memory arranged in the main unit 2 (not shown) executes validation of bills. That is to say, the CPU compares the data concerning with the true bills stored beforehand in the memory with the detected data concerning with the bills inserted therein, thereby it is judged whether the bills are true or not. Here, the bills judged as the true bills are fed to a bill guide part 4 in the stacker 1 through a bill feed unit 30 which becomes the bill feed device.

In FIG. 2, the bill feed unit 30 is constructed from a plurality of rubber roller pairs, the rubber rollers in each rubber roller pair facing with each other at both sides of a bill feed path 31. Rotational centers of the rubber rollers 31A~31E are fixed along the bill feed path 31. The rubber roller 31A, for example, is a drive wheel, and a belt BT is engaged around the rubber rollers 31A~31E. Thereby, based on that the rubber roller 31A is driven to rotate by a motor (not shown) and the like, rotational force is transmitted to the rubber rollers 31B~31E from the belt BT and such rollers are rotated.

The rubber rollers 32A~32E are frictional rollers to which rotational force is transmitted by the rubber rollers 31A~31E comprising roller pairs in cooperation with the rubber rollers 32A~32E. These rubber rollers 32A~32E are contacted to the rubber rollers 31A~31E, respectively, with a comparatively weak force enough for feeding the bill.

When the bill, which is fed along the bill feed path 31 by the rollers 31A~31E and 32A~32E, is received in the bill guide part 4, the bill feed unit 30 stops its feeding operation.

In this case, there may be a case that the most rear end of the bill is slightly held between the a pair of rubber rollers 31E and 32E (the rubber roller pair existing at the final stage among the plural rubber roller pairs), such rubber roller pair being arranged at a position nearest to the bill guide part 4. Operation to surely feed the bill in the above situation into the stacker 1 will be described hereinafter.

Next, construction of the stacker 1 will be explained according to FIG. 3 which corresponds to a view indicated by X-X arrow line in FIG. 2. Here, FIG. 3 is a top inner view of the stacker 1.

Figure 3:
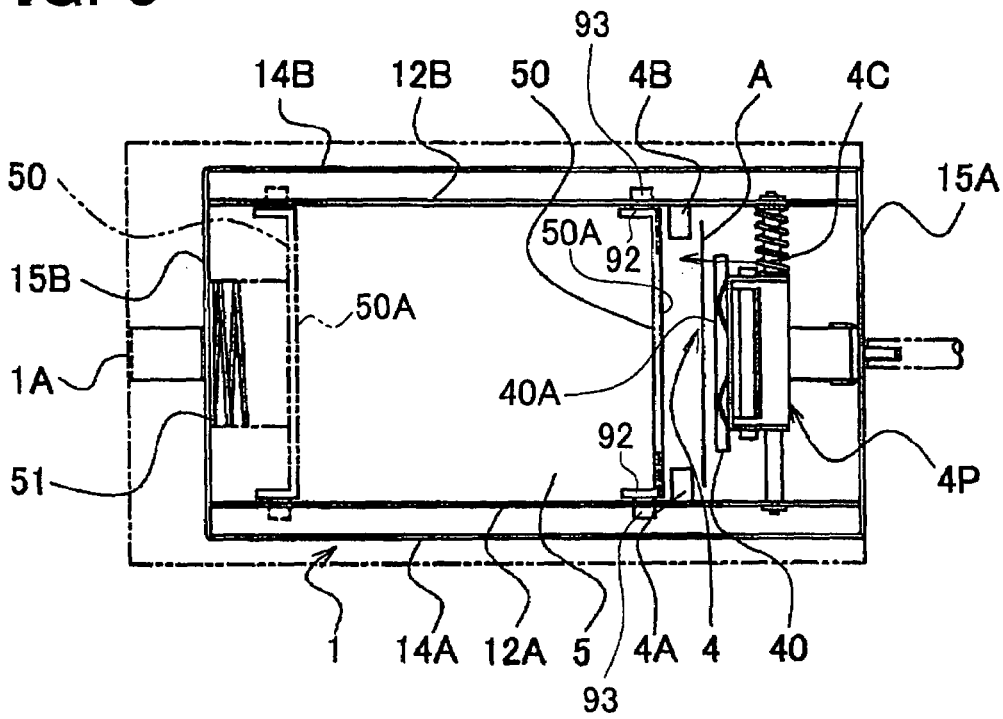
FIG. 3 is a top inner view of a stacker in the first embodiment according to the present invention.

In FIG. 3, the stacker 1 is rectangularly enclosed by side walls 14A and 14B, a front wall 15A and a rear wall 15B. In the stacker 1, side plates 12A and 12B are formed so as to stand in parallel with the side walls 14A, 14B, respectively.

Further, a parallel crank mechanism 4P is supported in the side plates 12A, 12B. The parallel crank mechanism 4P supports a push-in plate 40. At the upper part of the push-in plate 40, it is formed a bent portion 40B which is bent in a shape similar to the Japanese character "<" or in a shape having a slightly curved arc. And a bill support plate 50 is positioned at an opposite side of a bill push plane 40A in the push-in plate 40 by existing a pair of partition walls (stopper walls) 4A and 4B therebetween. Here, a pair of the partition walls 4A, 4B are fixed to the side plates 12A, 12B, respectively.

Further, as shown in FIGS. 2 and 3, a slide groove 91 (see FIG. 2. In FIG. 2, only the slide groove 91 in the side plate 12B is shown) is horizontally formed at substantially center position along the up and down directions in each of the side plates 12A, 12B. In each slide groove 91, a slide projection 93 is slidably supported, the slide projection 93 being formed on each ear portion 92 extended from both sides of the bill support plate 50 at substantially center position along the up and down directions. Thereby, the bill support plate 50 is made slidable in the stacker 1 in cooperation with the slide grooves 91 and the slide projections 93.

Between an opposite plane of the bill support plane 50A in the bill support plate 50 and the rear wall 15B, a compression coil spring 51 is arranged. The compression coil spring 51 gives a force so that the bill support plate 50 moves toward the partition walls 14A, 14B. The bill support plate 50 is retracted toward the rear wall 15B every the bill A pushed by the push-in plate 40 is piled on the bills already piled in the bill piling part 5.

In the above constructed stacker 1, it is provided a space with a thin rectangular parallelepiped shape, the space temporarily receiving the bill A, as the bill guide part 4 between the push-in plate 40 and the partition walls 4A, 4B. And a space, which is formed as a small opening having a width slightly narrower than a width of the bill A between the partition walls 4A, 4B, becomes a bill passage opening 4C. Further, a space for pushing the bill A pushed out through the bill passage opening 4C by the push-in plate 40, between the partition walls 4A, 4B and the bill support plane 50A of the bill support plate 50, is divided as the bill piling part 5.

Further, as shown in FIG. 2, the stacker 1 is covered by an upper wall 13A and it is formed in the upper wall 13A an opening 131 through which the bill A fed to the bill guide part 4 from the bill feed unit 30 passes. Further, a lower wall 13B of the stacker 1 is constructed as a door member which is made openable by using a hinge 132 as the rotational center.

Figure 4:
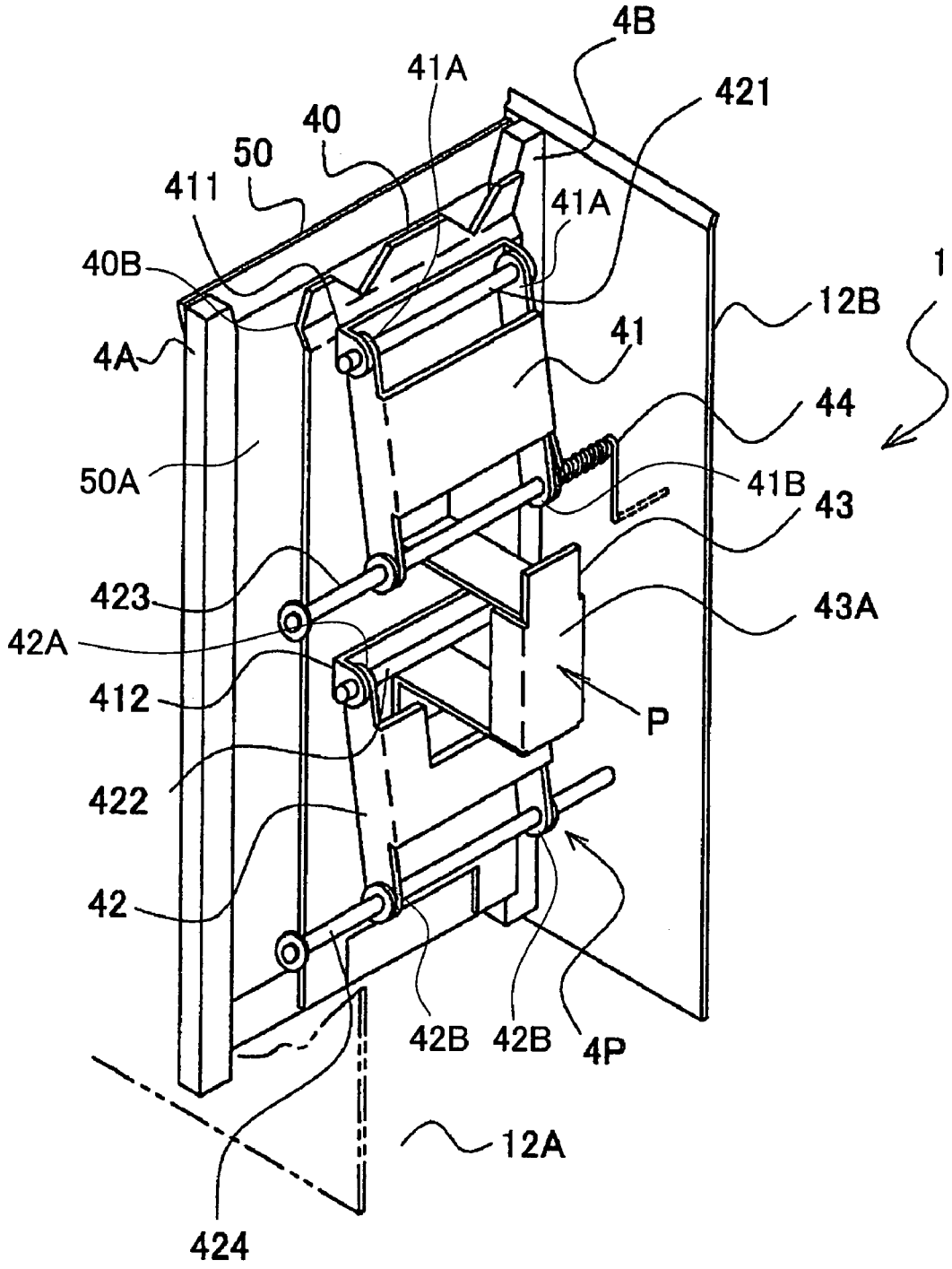
FIG. 4 is a perspective view partially showing the stacker in the first embodiment according to the present invention.

Next, construction of the parallel crank mechanism 4P arranged in the stacker 1 will be explained with reference to FIG. 4. FIG. 4 is a perspective view partially showing the stacker 1.

As shown in FIG. 4, a shaft support plate 411 is fixed to the rear upper portion of the push-in plate 40. Similarly, a shaft support plate 412 is fixed to the rear lower portion of the push-in plate 40. Further, at the rear plane of the push-in plate 40, a press force receiving plate 43 is fixed so as to protrude toward the front wall 15A (see FIG. 3). In the press force receiving plate, a contact plane 43A forms a parallel plane with the push-in plate 40.

In the shaft support plate 411, the first end 41A of the first swing arm 41, which becomes the first link, is rotatably connected through the first shaft 421. Similarly, in the shaft support plate 412, the first end 42A of the second swing arm 42, which becomes the second link, is rotatably connected through the second shaft 422.

Further, the second end 41B opposite to the first end 41A in the first swing arm 41 is rotatably connected to the first fixed shaft 423. Similarly, the second end 42B opposite to the first end 42A in the second swing arm 42 is rotatably connected to the second fixed shaft 424. The second end 41B of the first swing arm 41 and the second end 42B of the second swing arm 42 are rotatably supported to the side plates 12A, 12B through the first fixed shaft 423 and the second fixed shaft 424, respectively.

In FIG. 4, a torsion coil spring 44 is put on around the first fixed shaft 423. Here, the coil portion of the torsion coil spring 44 is put on around the first fixed shaft 423, the arm at one end of the torsion coil spring 44 is engaged to the side plane of the first swing arm 41, and the arm at the other end of the torsion coil spring 44 is engaged to the side plate 12B.

This torsion coil spring 44 has a function to exert torsion moment (torque) to the first swing arm 41 so that the push-in plate 40 approaches toward the front plate 15A (see FIG. 3). As mentioned, the stacker 1 can be made light and simply constructed by utilizing a simple member such as the torsion coil spring 44. More concretely, the torsion coil spring 44 gives rotational force to the first swing arm 41 so that the first swing arm 41 rotates in the clockwise direction in FIG. 4.

Here, in a case that the bill A is received in the bill guide part 4, the parallel crank mechanism 4P becomes in a closed state. That is, there occurs a state that the push-in plate 40 and the fixed link (mentioned later) approach with each other. And when force to parallel move the push-in plate 40 toward the bill support plate 50 is exerted from the main unit 2, the parallel crank mechanism 4P becomes in an opened state. That is, there occurs a state that the push-in plate 40 and the fixed link separate with each other. And when the force to parallel move the push-in plate 40 toward the bill support plate 50 is removed, the parallel crank mechanism 4P returns to the initial state by action of the torsion coil spring 44 which acts as a return member, thereby it is returned to a state that the bill A can be received in the bill guide part 4.

In FIG. 4, although the torsion coil spring 44 is put on around the first fixed shaft 423, the torsion coil spring 44 may be put on around the second fixed shaft 424. And the torsion coil springs 44 may be put on around both the first fixed shaft 423 and the second fixed shaft 424. Further, two torsion coil springs, which are wound in different directions, respectively, may be put on at both sides of the first fixed shaft 423.

The main object that the torsion coil spring 44 is arranged in the parallel crank mechanism 4P is that self-return of the parallel crank mechanism 4P can be accomplished. Therefore, for example, an extension spring as the self-return member may be arranged between the push-in plate 40 and the front plate 15A (see FIG. 3), thereby the parallel crank mechanism 4P may be self-returned. As mentioned, the self-return member for self-returning the parallel crank mechanism 4P is provided in the stacker 1, therefore the stacker 1 and the main unit 2 can be separated with each other without providing a special self-return mechanism in the stacker 1.

And as shown in FIG. 2, when force P vertical to the push-in plate 40 is exerted to the contact plane 43A of the press force receiving plate 43 from outside of the stacker 1, the push-in plate 40 is passed between the partition walls 4A and 4B. Thereby, the push-in plate 40 is moved to toward the bill support plate 50.

Next, while referring to FIG. 4, operation of the parallel crank mechanism 4P will be explained based on FIG. 2.

In FIG. 2, "R1" is the first rotational center of the first shaft 421 and "R2" is the second rotational center of the second shaft 422. Similarly, "R3" is the third rotational center of the first fixed shaft 423 and "R4" is the fourth rotational center of the second fixed shaft 424. The parallel crank mechanism 4P constructs a quadric chain mechanism based on the first rotational center R1, the second rotational center R2, the third rotational center R3 and the fourth rotational center R4.

In FIG. 2, the first distance (abbreviated as "L1" hereinafter) between the first rotational center R1 and the second rotational center R2 equals to the second distance (abbreviated as "L2" hereinafter) between the third rotational center R3 and the fourth rotational center R4. And, the third distance (abbreviated as "L3" hereinafter) between the first rotational center R1 and the third rotational center R3 equals to the fourth distance (abbreviated as "L4" hereinafter) between the second rotational center R2 and the fourth rotational center R4.

Further, the fixed link connecting the third rotational center R3 and the fourth rotational center R4 is arranged in the direction parallel with the movement direction of the bill A fed out from the bill feed unit 30. That is to say, the above mentioned fixed link is arranged parallel with the push-in plate 40. Here, in FIG. 2, the fixed link is a hypothetical link which is not directly indicated in Figures. Concretely, the side plates 12A and 12B (see FIG. 4) substantially construct the fixed link of he parallel crank mechanism 4P.

In the parallel crank mechanism 4P with the quadric chain mechanism as mentioned, the first rotational center R1 can conduct circular motion around the third rotational center R3 which is the fixed center and becomes the center of circular motion. And the second rotational center R2 can conduct circular motion around the fourth rotational center R4 which is the fixed center and becomes the center of circular motion.

In the quadric rotation chain mechanism, concerning with each link length, there exist relations that the first distance L1=the second distance L2 and the third distance L3=the fourth distance L4. At this point of view, the above quadric rotation chain mechanism becomes the parallel crank mechanism which is the lever crank mechanism with specific measurements.

Therefore, when the force P (see FIG. 4) for moving the push-in plate 40 parallel toward the bill support plate 50 is exerted thereto from the main unit 2 side, the push-in plate 40, which becomes the movable link and has the first rotational center R1 and the second rotational center R2, can be moved to a direction along which the push-in plate 40 draws and separates the bill A toward the length direction thereof and can be moved toward the bill support plate 50 while retaining the parallel relation therebetween. That is to say, every point existing in the push-in plate 40 conducts circular motion. As mentioned, the parallel crank mechanism 4P with simple construction is provided in the stacker 1, therefore the stacker 1 detachable to the main unit 2 can be miniaturized.

Next, with reference to FIGS. 2 and 5, it will be described a bill push-in device of the first embodiment for moving the parallel crank mechanism 4P. Here, FIG. 5 is an exploded perspective view of a bill push-in device in the first embodiment.

In FIG. 2, the bill push-in device 6 is mainly constructed from a reciprocating rod 61, a roller 62, a follower cam 63, a first gear 64, a second gear 65, a worm gear 66, a worm 67, and a motor 68. And members constructing the bill push-in device 6 are arranged in the main unit 2 as shown in FIG. 2.

Figure 5:
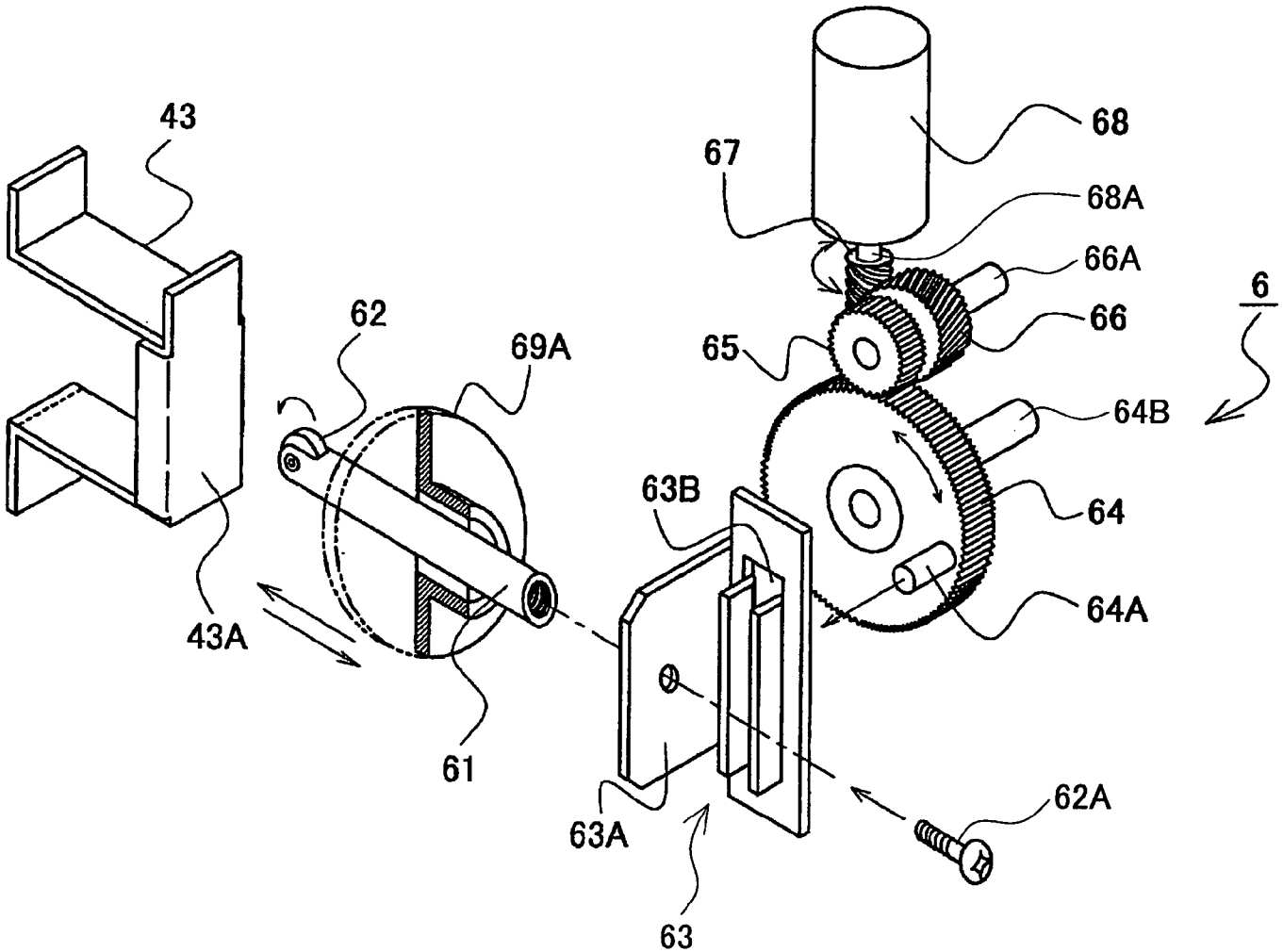
FIG. 5 is an exploded perspective view of a bill push-in device in the first embodiment according to the present invention.

As shown in FIG. 5, in the bill push-in device 6, the reciprocating rod 61 has the roller 62 at the top end thereof, to contact with the contact plane 43A of the press force receiving plate 43. Further, the reciprocating rod 61 is arranged so as to normally cross the contact plane 43A. That is to say, the reciprocating rod 61 is arranged so as to substantially normally cross the contact plane 43A and to be able to reciprocatingly move through an opening 151 formed in the front wall 15A. The roller 62 rolls and moves, thus slide connection to the contact plane 43A can be easily done.

As mentioned, the reciprocating rod 61 is arranged so as to pull in and pull out from the stacker 1 and is also arranged along the same direction as the insert and pull direction of the stacker 1 in the bill handling apparatus 100. Accordingly, the push-in plate 40 can be moved from the bill guide part 4 to the bill piling part 5 without providing the bill push-in device 6 in the stacker 1.

The shaft portion of the reciprocating rod 61 is slidably held by a bush 69A with a flange. And the shaft portion of the reciprocating rod 61 may be held linear motion bearings combined in the bush 69A and may be held by oilless metal. The bush 69A with the flange is fixed on a stay 69B (see FIG. 2) which is installed in the main unit 2 (see FIG. 2).

As shown in FIG. 5, a female screw 62A is formed at the rear end of the reciprocating rod 61 and the rear end of the reciprocating rod 61 is fixed to a plate portion 63A with a shape of L character, the plate portion 63A being integrally formed in the follower cam 63, by a fastener such as a screw 62A. Further, the follower cam 63 has a guide groove 63B formed in a direction normal to the movement direction of the reciprocating rod 61.

The first gear 64 fixed on a rotational shaft 64B has a crank pin 64A positioned outside of the rotational center thereof, and this crank pin 64A is movably connected to the guide groove 63B of the follower cam 63. The first gear 64 and the follower cam 63 construct a cam device through which rotational motion of the first gear 64 is converted to linear motion of the reciprocating rod 61.

The second gear 65 transmits rotational motion thereof to the first gear 64. The first gear 64 and the second gear 65 are arranged so that both rotational axes become parallel. Here, both the first and second gears 64, 65 may be spur gears or helical gears. The rotational axes of the first gear 64 and the second gear 65 are supported at their one side ends. And the first gear 64 is a small gear and the second gear 65 is a large gear. According to such construction, torque needed for the motor 68 can be reduced.

The worm gear 66 is coaxially fixed to a rotational shaft 66A of the second gear 65. And the motor 68 has a worm 67 at its rotational shaft 68A, the worm 67 being meshed with the worm gear 66. Here, the rotational shaft 68A of the motor 68 and the rotational shaft 66A of the second gear 65 are arranged so as to cross each other as shown in FIG. 5, thereby the bill push-in device 6 can be compacted and the space for the bill push-in device 6 can be reduced.

Next, operation of the bill handling apparatus 100 in the embodiment will be explained according to FIGS. 2 and 6. Here, FIG. 6 is a longitudinal sectional view partially showing the bill handling apparatus in the first embodiment according to the present invention, the view indicating a state changed from a state shown in FIG. 2

In FIG. 2, when the bill is received in the bill guide part 4, the motor 68 is driven based on an instruction from the control unit (not shown). And according to that the motor 68 is driven, rotational motion of the motor 68 is converted in linear motion of the reciprocating rod 61.

Figure 6:
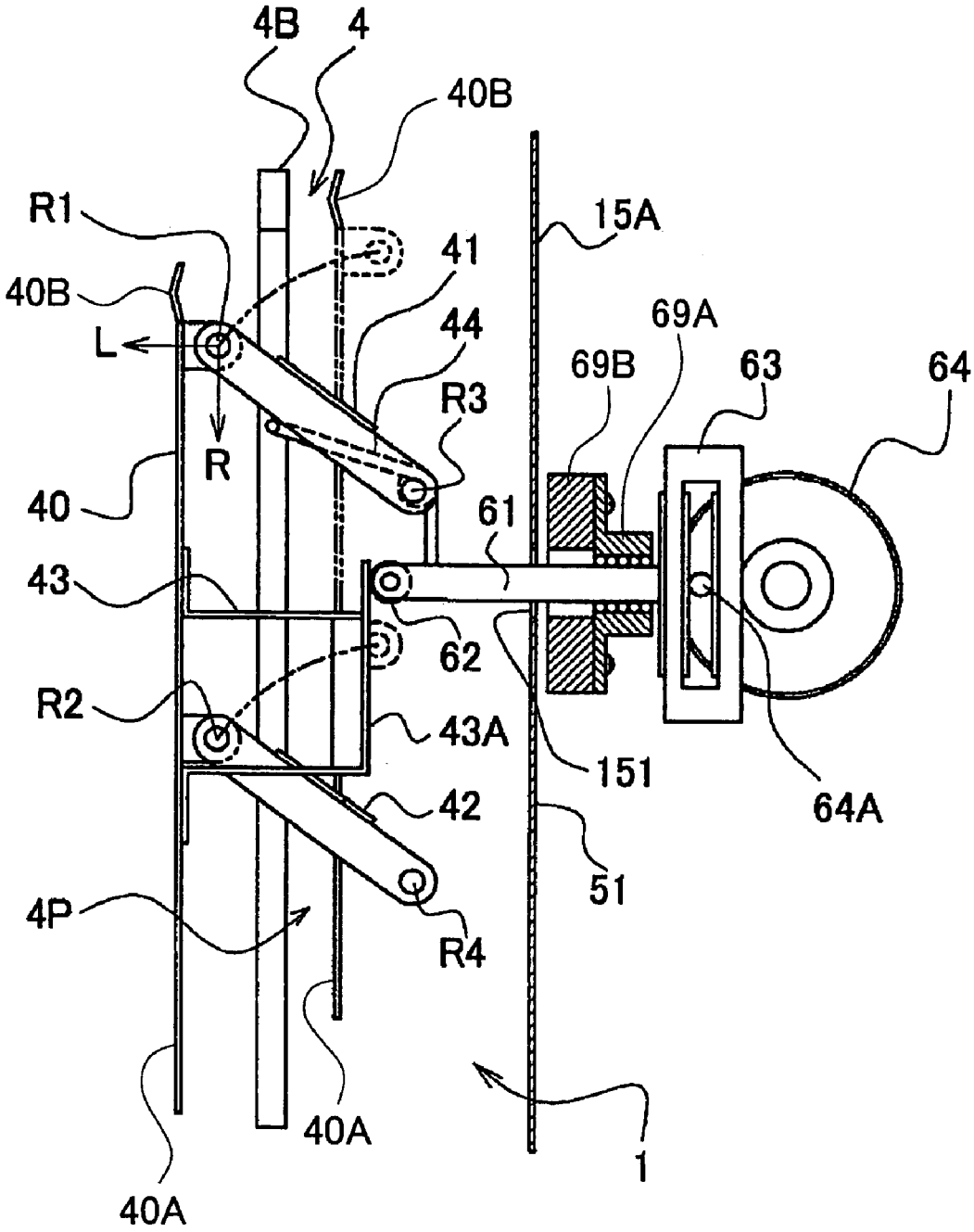
FIG. 6 is a longitudinal sectional view partially showing the bill handling apparatus in the first embodiment according to the present invention, the view indicating a state changed from a state shown in FIG. 2.

In FIG. 6, the crank pin 64A of the first gear 64 is rotated by ½ rotation (180 degrees) from the state shown in FIG. 2. That is to say, the reciprocating rod 61 is moved toward the stacker 1 by a distance corresponding to twice of radius of the crank pin 64A, the radius being a distance between the rotational center of the first gear 64 and the crank pin 64A. And the top end of the reciprocating rod 61 pushes the contact plane 43A of the press force receiving plate 43 through the opening 151 formed in the front wall 15A.

Further, the first swing arm 41 and the second swing arm 42 are rotated with a mutual connection therebetween in the anti-clockwise direction around the third rotational center R3 and the fourth rotational center R4, corresponding to forward movement of the reciprocating rod 61. At that time, the push-in plate 40 goes down, thereby the roller 62 rolls on the contact plane 43A while pushing the contact plane 43A.

On the other hand, according to movement of the push-in plate 40, horizontal component L and vertical component R operate as shown in FIG. 6. And as shown in FIG. 3, the push-in plate 40 passes between the partition walls 4A and 4B and moves toward the bill support plate 50. At that time, based on the vertical component R which occurs when the push-in plate 40 rotates and moves, it can be surely fed in the bill piling part 5 (see FIG. 3) the bill A, the most rear end of which is partially held by a pair of the rubber rollers 31E and 32E at the final stage and is slightly released.

Further, the bill fed in the bill guide part 4 through the rubber rollers 31A, 32E is bent in a shape similar to the character "V" or in a shape having a slightly curved arc by the bent portion 40B formed at the upper part of the push-in plate 40. Thereby, if the bill A does not fall by natural fall in the bill guide part 4, the push-in plate 40 gives a downward force (force in the direction of natural fall of the bill) to the bill through the bent portion 40B of the push-in plate 40 and moves toward the bill support plate 50 while retaining a parallel relation therebetween and contacting with the bill. Therefore, the bill can be reformed in a plain state and stacked in the bill piling part 5 (see FIG. 3).

When the motor 68 (see FIG. 2) is driven from a state shown in FIG. 6 and the crank pin 64A of the first gear 64 rotates by ½ rotation (180 degrees), the reciprocating rod 61 returns to a state shown in FIG. 2. In connection with movement of the reciprocating rod 61, the parallel crank mechanism 4P returns to a state shown in FIG. 2 based on returning force of the torsion coil spring 44. Thereafter, the push-in plate 40 waits to receive the next bill.

Here, as shown in FIG. 2, since the contact plane 43A of the press force receiving plate 43 contacts to the front wall 15A, the parallel crank mechanism 4P does not move therefrom. And in FIG. 2, since the reciprocating rod 61 and the front wall 15A are separated with each other, the stacker 1 can be pulled out from the main unit 2.

Based on that the above mentioned operation is repeated, the bill A fed in the bill piling part 5 as shown in FIG. 3 is stacked in a plain state by being pressed between the bill support plate 50 and the partition walls 4A, 4B.

Figure 7:
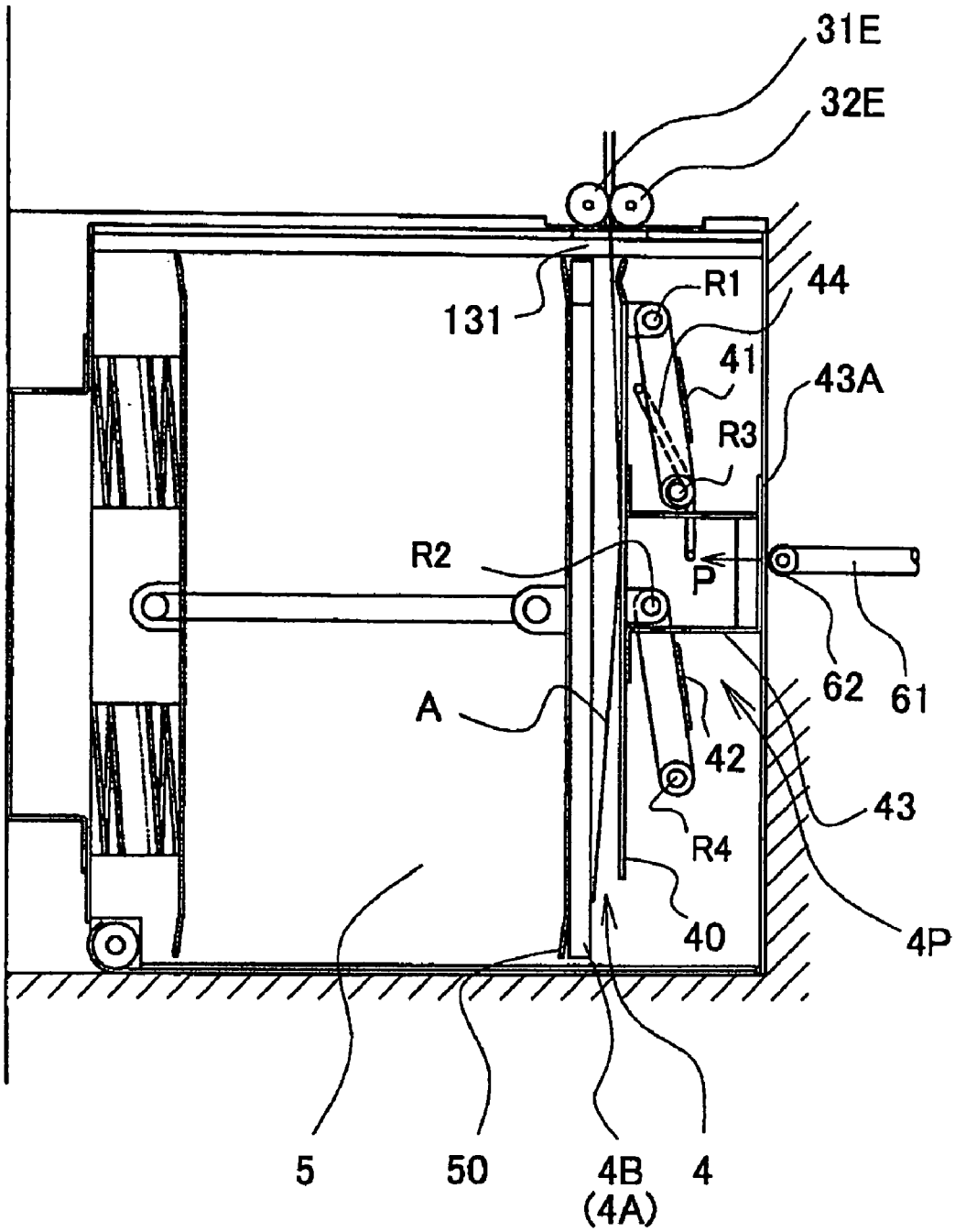
FIG. 7 is a partial view of FIG. 2, showing a state that a bill is received in a bill guide part, in the first embodiment according to the present invention.

Next, changing state of the bill will be described. FIG. 7 is a partial view of FIG. 2. In FIG. 7, the bill A finally fed out by the rubber rollers 31E, 32E is bent in a shape similar to the character "V" in the bill guide part 4, as mentioned. And the bill A partially contacts with the push-in plate 40 and the partition walls 4A, 4B. In this state, the bill A does not fall by its self-weight therefrom.

Figure 8:
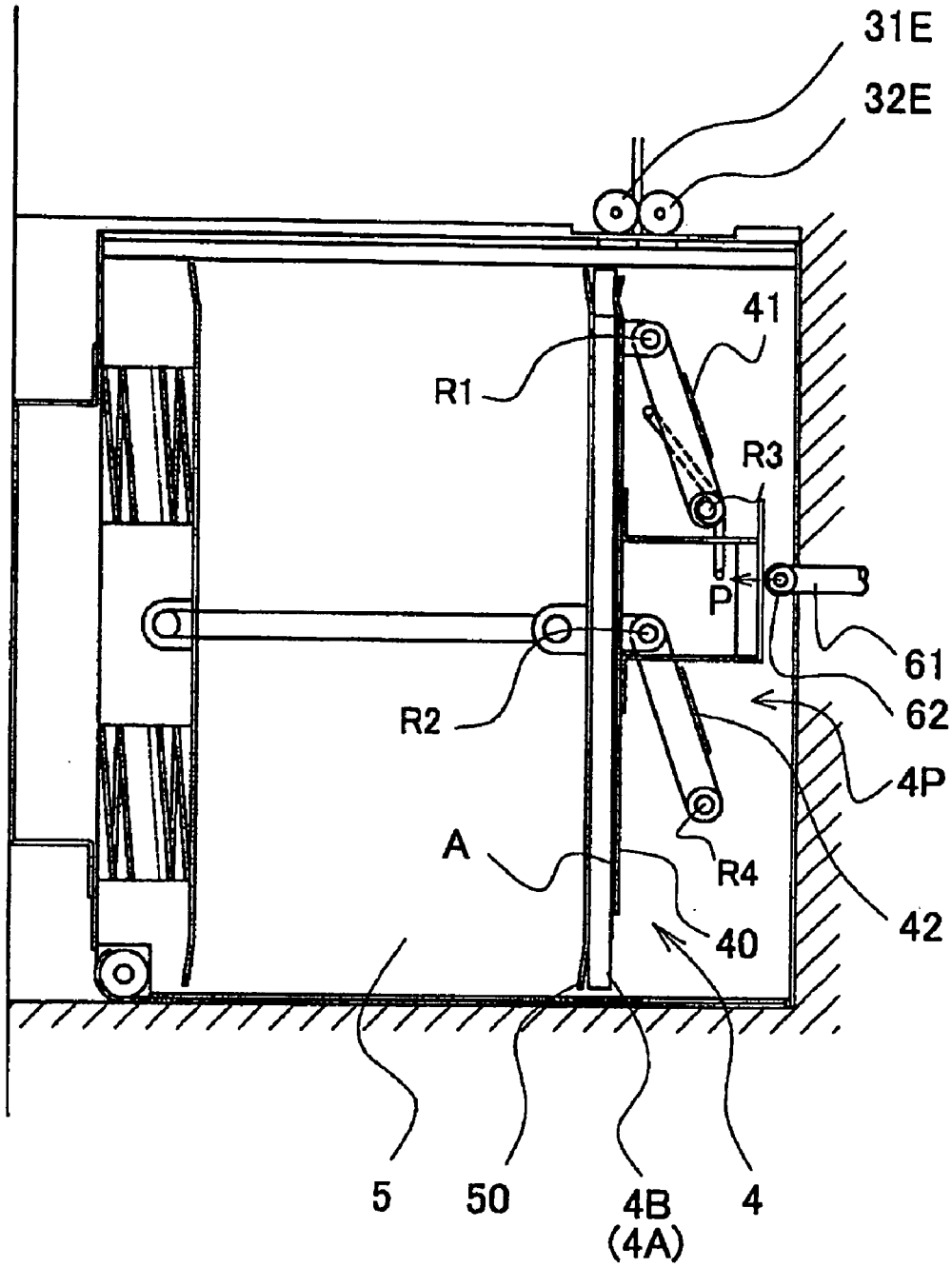
FIG. 8 is a partial view of FIG. 2, showing a state that a push-in plate moves to the left direction, in the first embodiment according to the present invention.

FIG. 8 is a partial view of FIG. 2, showing a state that the force P is exerted to the push-in plate 40 when the reciprocating rod 61 is moved, so that the push-in plate 40 parallel moves toward the bill support plate 50.

In FIG. 8, the push-in plate 40 contacts to the bill A, thereby the bill A is reformed in a plain state from the bent state mentioned above through the push-in plate 40 and the partition walls 4A, 4B. Here, during a process shifting from the state in FIG. 7 to the state in FIG. 8, the downward force (the force for drawing and separating the bill A from the rubber rollers 31E and 32E) is given to the bill A by the push-in plate 40.

Figure 9:
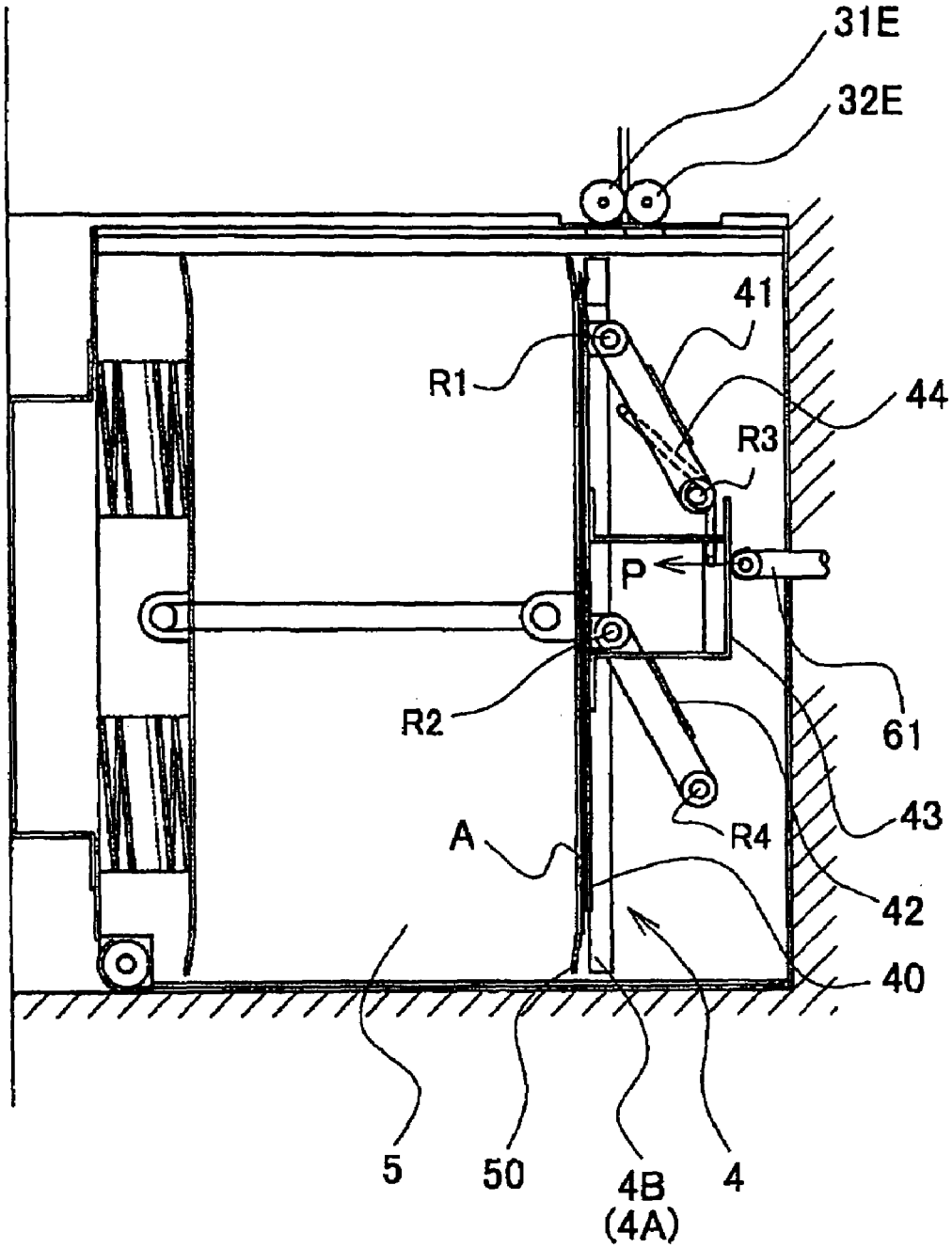
FIG. 9 is a partial view of FIG. 2, showing a state that the push-in plate holds the bill in cooperation with a bill support plate, in the first embodiment according to the present invention.

FIG. 9 is a partial view of FIG. 2, showing a state that the push-in plate 40 holds the bill in cooperation with the bill support plate 50, when the reciprocating rod 61 is moved.

Figure 10:
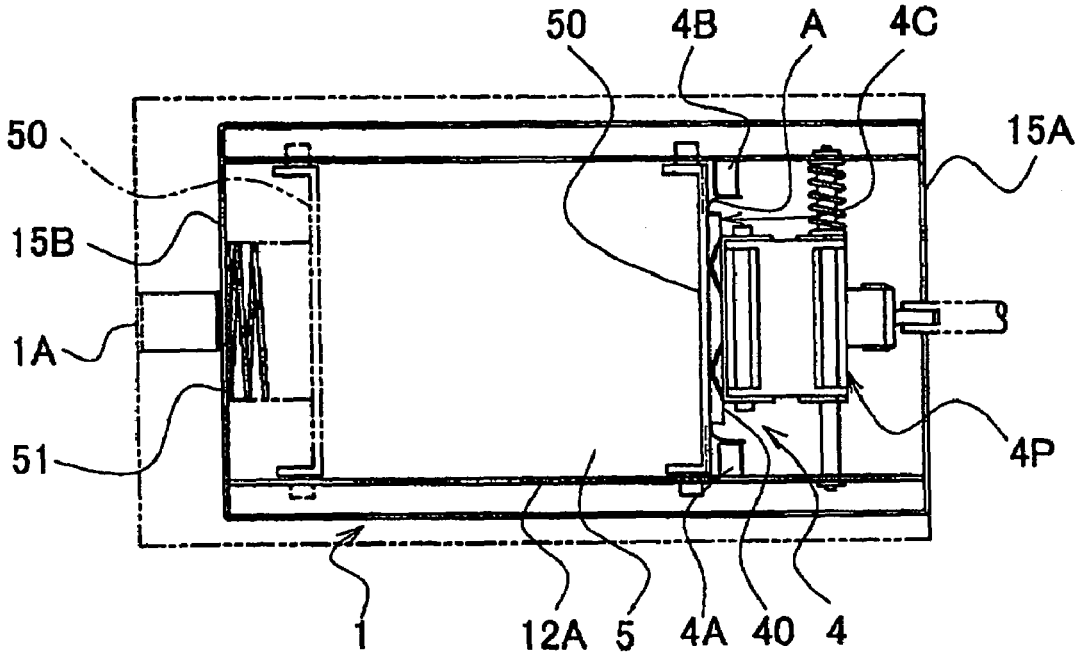
FIG. 10 is a top inner view of the stacker which retained in a state shown in FIG. 9.

FIG. 10 is the top inner view of the stacker 1 which is retained in a state shown in FIG. 9. In FIG. 10, width of the bill passage opening 4C formed by the partition walls 4A, 4B is formed slightly narrower than that of the bill A. And the width of the bill passage opening 4C is formed slightly wider than that of the push-in plate 40.

Therefore, in the state shown in FIG. 10, the bill A is folded in a shape of the character "U" in the width direction thereof. Here, during a process shifting from the state in FIG. 8 to the state in FIG. 9, the downward force (the force for drawing and separating the bill A from the rubber rollers 31E and 32E) is also given to the bill A by the push-in plate 40.

Figure 11:
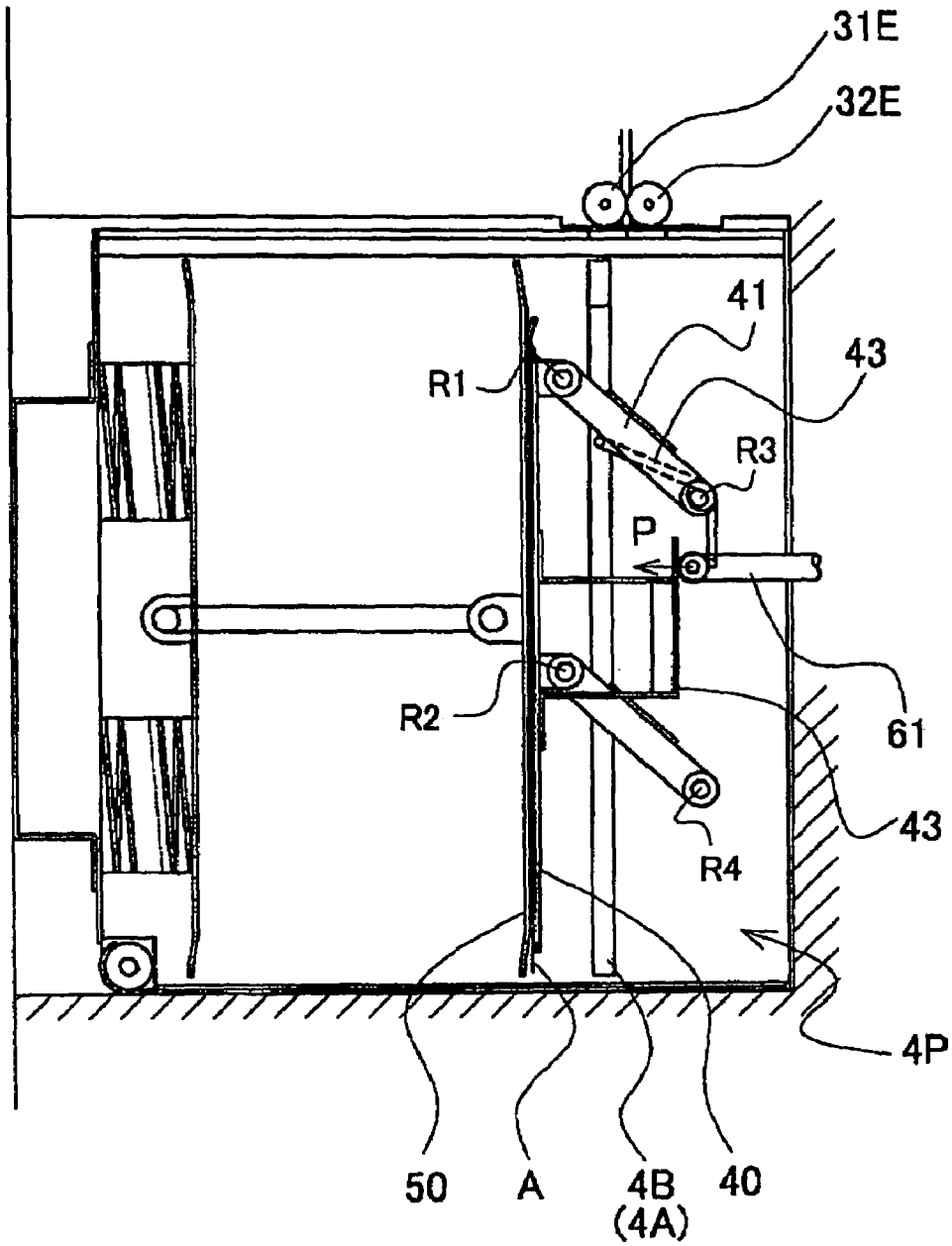
FIG. 11 is a partial view of FIG. 2, showing a state that a reciprocating rod moves to the most left position, in the first embodiment according to present invention.
Figure 12:
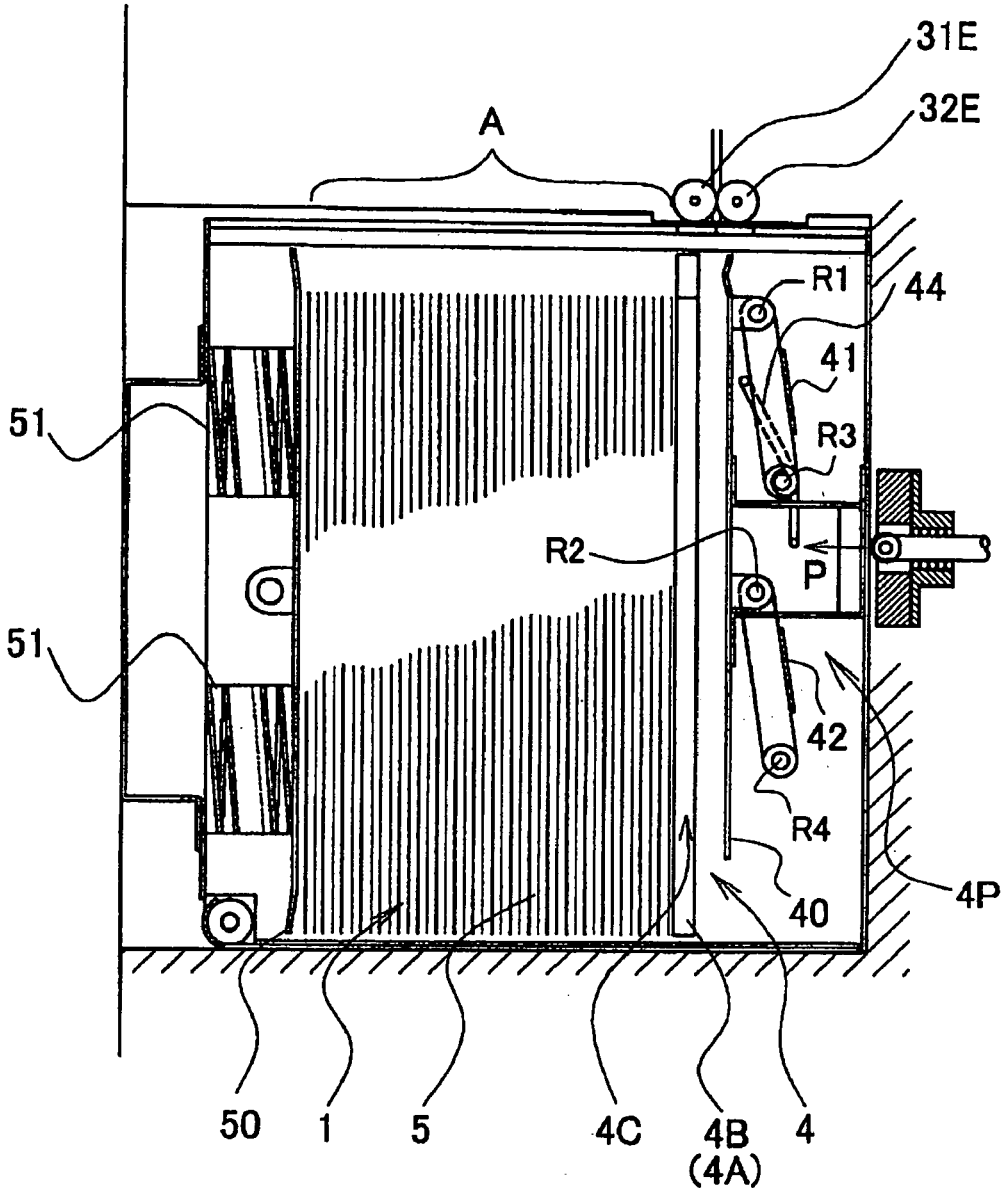
FIG. 12 is a view showing a state that bills are accumulated in a bill piling part under a pressing state thereof, in the first embodiment according to the present invention.

FIG. 11 is a partial view of FIG. 2, showing a state that the reciprocating rod 61 moves to the most left position while retaining the state that the push-in plate 40 holds the bill A in cooperation with the bill support plate 50.

In FIG. 11, the push-in plate 40 no longer moves toward the left direction. And during a process shifting from the state in FIG. 9 to the state in FIG. 11, the bill A returns in the plain state by the self-returning force thereof from the state folded in a shape of the character "U" as shown in FIG. 10.

Further, when the push-in plate 40 moves (retracts) toward the right direction to receive the next bill A, the push-in plate 40 and the bill support plate 50 moves (retract) while holding the bill A returning in the plain state therebetween. In the process that the push-in plate 40 moves (retracts), the bill A is blocked by the partition walls 4A, 4B (see FIG. 10), thereby only the push-in plate 40 moves (retracts). And the bill A is retained in the plain state by the partition walls 4A, 4B.

Based on that the above mentioned process is repeated, the bills A pushed out by the push-in plate 40 are stacked and accumulated in the bill piling part 5 under a pressed state between the bill passage opening 4C and the bill support plate 50.

Figure 13:
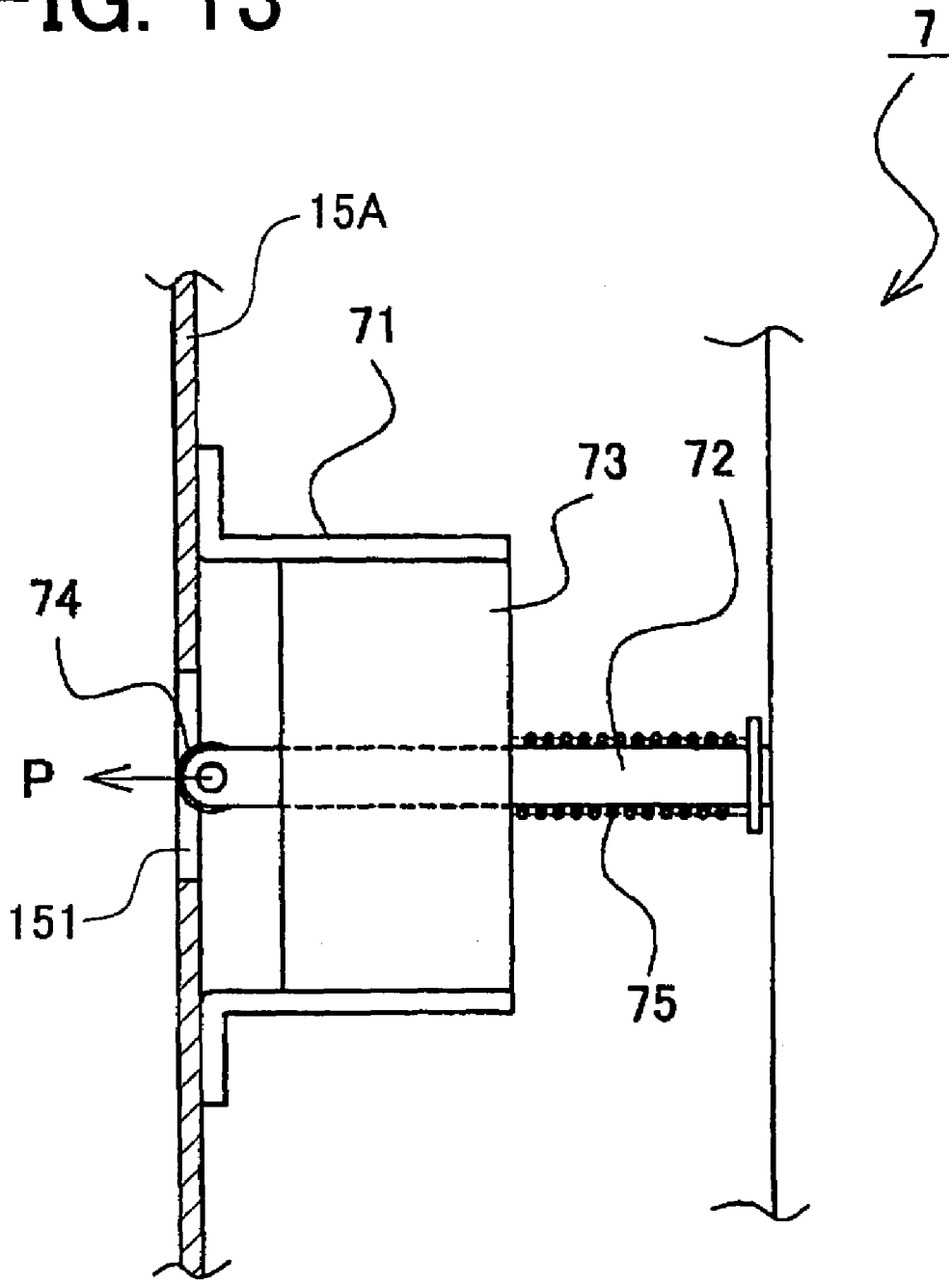
FIG. 13 is an explanatory view of the bill push-in device in the second embodiment according to the present invention.

Next, the bill push-in device 6 utilized for operating the parallel crank mechanism 4P will be explained according to the second embodiment with reference to FIG. 13. FIG. 13 is an explanatory view of the bill push-in device in the second embodiment. Here, in FIG. 13, the parallel crank mechanism is omitted.

In FIG. 13, a bill push-in device 7 has a magnetic solenoid 71 therein. The magnetic solenoid 71 exerts the power P to the push-in plate 40 shown in FIG. 2, so that the push-in plate 40 parallel moves toward the bill support plate 50.

The magnetic solenoid 71 is constructed from a plunger 72 with both ends and a magnetic core 73. The plunger 72 has a roller 74 at the top end thereof, the roller 74 contacting to the press force receiving plate 43 (see FIG. 2). At the other end of the plunger 72, a compression coil spring 75 is put on. The compression coil spring 75 gives a force to move the plunger 72 toward the right direction in FIG. 13.

And the plunger 72 is arranged so as to normally cross with the contact plane 43A (see FIG. 2) of the press force receiving plate 43. That is to say, the plunger 72 is arranged so as to be able to reciprocatingly move in the direction substantially normal to the push-in plate 40 (see FIG. 2) through the opening 151 formed in the front wall 15A. The roller 74 rolls and moves, thus slide connection to the contact plane 43A can be easily done.

In the bill push-in device 7 shown in FIG. 13, when the magnetic solenoid 71 is energized, the magnetic core 73 is magnetized, thereby the magnetic core 73 attracts the plunger 72 in the left direction. And when driving of the magnetic core 73 is ceased, the plunger 72 returns to the right direction shown in FIG. 13 based on urging force of the compression coil spring 75.

In the bill push-in device 7 according to the second embodiment, the magnetic solenoid 71 is driven and controlled by an instruction from the control unit (not shown). As mentioned, based on driving and controlling the magnetic solenoid 71, the parallel crank mechanism 4P (see FIG. 2) connected to the bill push-in device 7 can be opened and closed.

The bill push-in device 7 of the second embodiment has a simple construction and can directly open and close the parallel crank mechanism 4P (see FIG. 2). Thereby, the bill push-in device 7 can be simply constructed. Further, the plunger 72 is arranged so as to be able to enter in and go out from the stacker 1 and is also arranged along the same direction as the insert and pull direction of the stacker 1 in the bill handling apparatus 100. Accordingly, the push-in plate 40 can be moved from the bill guide part 4 to the bill piling part 5 without providing the bill push-in device 7 in the stacker 1.

Figure 14:
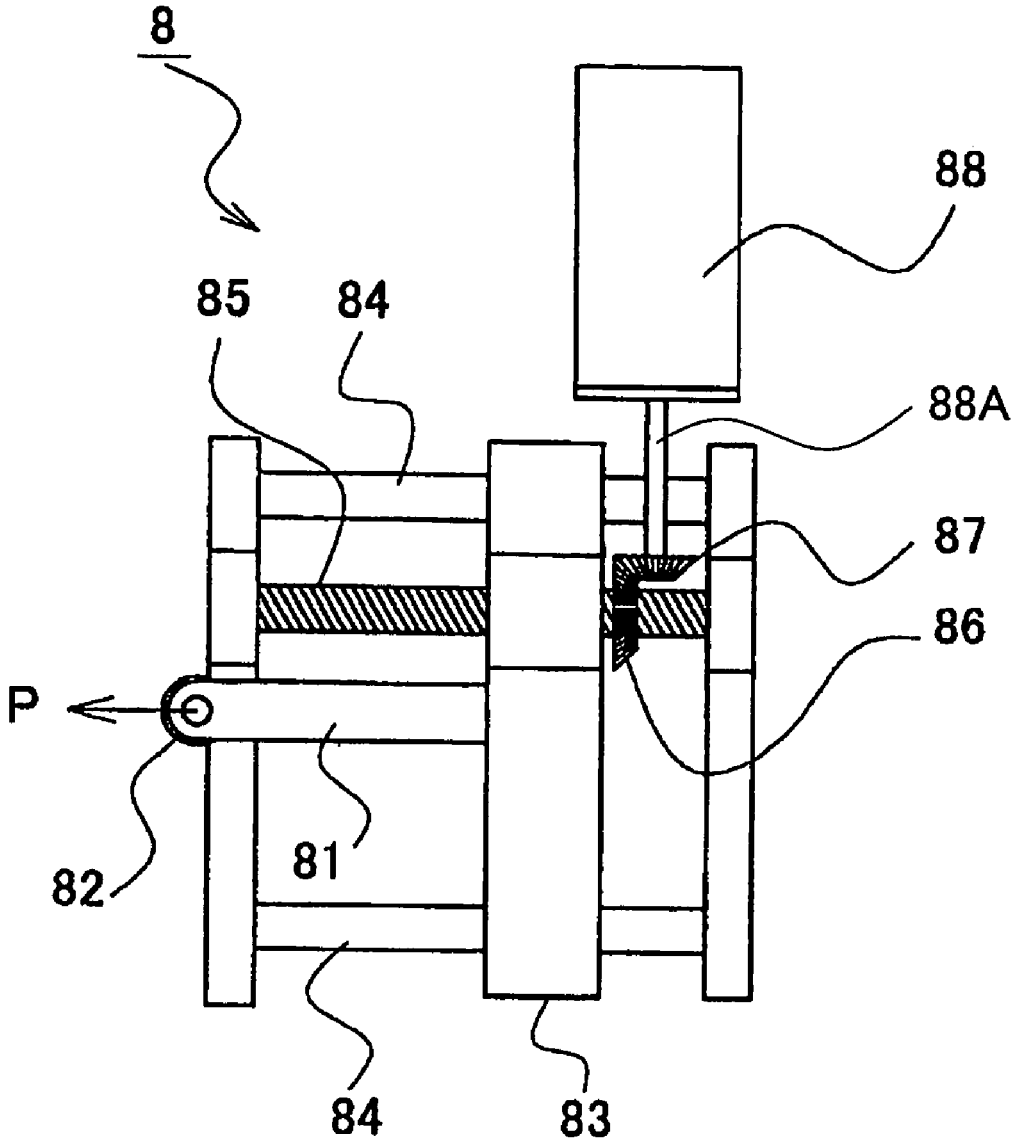
FIG. 14 is an explanatory view of the bill push-in device in the third embodiment according to the present invention.

Next, the bill push-in device 8 utilized for operating the parallel crank mechanism 4P will be explained according to the third embodiment with reference to FIG. 14. FIG. 14 is an explanatory view of the bill push-in device 8 in the third embodiment. Here, in FIG. 14, the parallel crank mechanism is omitted.

In FIG. 14, a reciprocating rod 81 is arranged so as to be able to reciprocatingly move in the direction substantially normal to the push-in plate 40 (see FIG. 2) through the opening 151 formed in the front wall 15A. The reciprocating rod 81 has a roller 82 at the top end thereof to contact to the press force receiving plate 43 (see FIG. 2).

The rear end of the reciprocating rod 81 is supported in a movable base 83. The movable base 83 parallel moves in the direction normal to the push-in plate 40 (see FIG. 2). Guide shafts 84 are parallel arranged so that the guide shafts 84 are slidably connected to the movable base 83, thereby the movable base 83 moves parallel with the push-in plate 40.

A ball screw 85 is arranged parallel with the guide shafts 84 and connected to the movable base 83 in cooperation with screw portion formed on the surface of the ball screw and the ball nut (mentioned later) arranged in the movable base 83. The first bevel gear 86 is fixed coaxially with the ball screw 85. The motor 88 has the second bevel gear 87 on the rotational shaft 88A thereof, the second bevel gear 87 meshing with the first bevel gear 86.

In the bill push-in device 8 shown in FIG. 14, when the motor 88 is driven, rotation of the second bevel gear 87 is transmitted to the first bevel gear 86 and to the ball screw 85 which rotates with the first bevel gear 86. Here, the ball nut is arranged in the movable base 83 and such ball nut is meshed with the ball screw 85. That is to say, rotational motion of the ball screw 85 is converted to linear motion of the movable base 83.

The guide shafts 84 parallel arranged with each other guide the linear motion of the movable base 83. The reciprocating rod 81 is arranged in the movable base 83 so as to normally cross with the push-in plate 40 (see FIG. 2) and the roller 82 at the top end of the reciprocating rod 81 rolls and moves on the contact plane 43A (see FIG. 2), thus slide connection to the contact plane 43A can be easily done.

Further, the reciprocating rod 81 is arranged so as to be able to enter in and go out from the stacker 1 and is also arranged along the same direction as the insert and pull direction of the stacker 1 in the bill handling apparatus 100. Accordingly, the push-in plate 40 can be moved from the bill guide part 4 to the bill piling part 5 without providing the bill push-in device 8 in the stacker 1.

Although embodiments utilizing the bill as the paper sheet are explained, the present invention is not limited to these embodiments. For example, if card type paper sheets are use as the paper sheets, the object of the present invention can be realized by components, elements other than those indicated in the above embodiments. And although the bill handling apparatus of the embodiments is, for example, utilized in the gaming machines and the like, such apparatus may be utilized for vending machines or various coin changers.

What is claimed is:

1. A sheet handling apparatus including:

a main unit;

a sheet validating device for determining whether a sheet received from outside is valid or not, the sheet validating device being provided in the main unit;

a sheet receiving unit, which is detachable from the main unit;

a sheet feed device for feeding the sheet, which is determined as valid, by the sheet validating device to the sheet receiving unit;

a plurality of stopper walls disposed in the sheet receiving unit;

a sheet support plate slidably arranged in the sheet receiving unit, the sheet support plate having a sheet support plane which is urged toward at least one side of the stopper walls;

a sheet push plate arranged at the other side of the stopper walls so as to face the sheet support plane, the sheet push plate moving the sheet fed to the sheet receiving unit through the sheet feed device, toward the sheet support plane while pushing the sheet; and a push device for rotating the sheet push plate downward while retaining a parallel relation between a sheet push plane of the sheet push plate and the sheet support plane of the sheet support plate, thereby the sheet push plate draws and separates the sheet fed to the sheet receiving unit from the sheet feed device and pushes the sheet to the sheet support plane of the sheet support plate, wherein the push device is constructed from a parallel crank mechanism connected to the sheet push plate, wherein the parallel crank mechanism comprises:

a first link with a first end which is rotatably connected to a first rotational center positioned at an upper part of the sheet push plate;

a second link with a first end which is rotatably connected to a second rotational center positioned at a lower part of the sheet push plate;

a first shaft which is connected to a third rotational center positioned at a a first shaft which is connected to a third rotational center positioned at a second end opposite to the first end in the first link, the second end being rotatable around the first shaft; and a second shaft which is connected to a fourth rotational center positioned at a second end opposite to the first end in the second link, the second end being rotatable around the second shaft;

whereby the parallel crank mechanism constructs a quadric chain mechanism, and wherein a first distance between the first rotational center and the second rotational center equals to a second distance between the third rotational center and the fourth rotational center, wherein a third distance between the first rotational center and the third rotational center equals to a fourth distance between the second rotational center and the fourth rotational center, and wherein a fixed link connecting the third rotational center and the fourth rotational center is arranged substantially parallel with a movement direction of the sheet fed out from the sheet feed device.

2. The sheet handling apparatus according to claim 1, further comprising: a return member for urging the sheet push plate toward the fixed link.

3. The sheet handling apparatus according to claim 2, wherein the return member comprises a torsion coil spring put on the first shaft or the second shaft.

4. The sheet handling apparatus according to claim 1, further comprising a drive device arranged in the main unit outside of the sheet receiving unit;

wherein the sheet receiving unit with the parallel crank mechanism is constructed so as to be able to separate from the drive device.

5. A sheet handling apparatus including:

a sheet validating device for determining whether a sheet received from outside is valid or not, the sheet validating device being provided in the main unit;

a sheet receiving unit which is detachable from the main unit;

a sheet feed device for feeding the sheet which is determined as valid by the sheet validating device to the sheet receiving unit;

a plurality of stopper walls disposed in the sheet receiving unit;

a sheet support plate slidably arranged in the sheet receiving unit, the sheet support plate having a sheet support plane which is urged toward at least one side of the stopper walls;

a sheet push plate arranged at the other side of the stopper walls so as to face the sheet support plane, the sheet push plate moving the sheet fed to the sheet receiving unit through the sheet feed device, toward the sheet support plane while pushing the sheet;

a push device for rotating the sheet push plate downward while retaining a parallel relation between a sheet push plane of the sheet push plate and the sheet support plane of the sheet support plate, thereby the sheet push plate draws and separates the sheet fed to the sheet receiving unit from the sheet feed device and pushes the sheet to the sheet support plane of the sheet support plate; and a drive device arranged in the main unit outside of the sheet receiving unit, the drive device driving the push device;

wherein the drive device comprises:

a reciprocating rod having a roller pushing the sheet push plate at a top end thereof, the reciprocating rod being movably arranged in a direction normal to the sheet push plane of the sheet push plate;

a follower cam supporting a rear end of the reciprocating rod and having a guide groove in a direction normal to a movement direction of the reciprocating rod;

a first gear having a crank pin which is movably connected to the guide groove in the follower cam, the crank pin being positioned outside of a rotational center thereof;

a second gear for transmitting rotational motion to the first gear;

a second gear for transmitting rotational motion to the first gear;

a worm gear fixed coaxially with the second gear; and a motor having a rotational shaft on which a worm meshing with the worm gear is fixed.

6. A sheet handling apparatus including:

a main unit;

a sheet validating device for determining whether a sheet received from outside is valid or not, the sheet validating device being provided in the main unit;

a sheet receiving unit which is detachable from the main unit;

a sheet feed device for feeding the sheet which is determined as valid by the sheet validating device to the sheet receiving unit;

a plurality of stopper walls disposed in the sheet receiving unit;

a sheet support plate slidably arranged in the sheet receiving unit, the sheet support plate having a sheet support plane which is urged toward at least one side of the stopper walls;

a sheet push plate arranged at the other side of the stopper walls so as to face the sheet support plane, the sheet push plate moving the sheet fed to the sheet receiving unit through the sheet feed device, toward the sheet support plane while pushing the sheet;

a push device for rotating the sheet push plate downward while retaining a parallel relation between a sheet push plane of the sheet push plate and the sheet support plane of the sheet support plate, thereby the sheet push plate draws and separates the sheet fed to the sheet receiving unit from the sheet feed device and pushes the sheet to the sheet support plane of the sheet support plate; and a drive device arranged in the main unit outside of the sheet receiving unit, the drive device driving the push device;

wherein the drive device comprises:

a plunger having a roller pushing the sheet push plate at a top end thereof and a compression coil spring put on a rear end thereof; and a magnetic solenoid with a magnetic core for attracting the plunger so as to be moved toward the sheet push plate by energizing thereof.

7. A sheet handling apparatus including:

a main unit;

a sheet validating device for determining whether a sheet received from outside is valid or not, the sheet validating device being provided in the main unit;

a sheet receiving unit which is detachable from the main unit;

a sheet feed device for feeding the sheet which is determined as valid by the sheet validating device to the sheet receiving unit;

a plurality of stopper walls disposed in the sheet receiving unit;

a sheet support plate slidably arranged in the sheet receiving unit, the sheet support plate having a sheet support plane which is urged toward at least one side of the stopper walls;

a sheet push plate arranged at the other side of the stopper walls so as to face the sheet support plane, the sheet push plate moving the sheet fed to the sheet receiving unit through the sheet feed device, toward the sheet support plane while pushing the sheet;

a push device for rotating the sheet push plate downward while retaining a parallel relation between a sheet push plane of the sheet push plate and the sheet support plane of the sheet support plate, thereby the sheet push plate draws and separates the sheet fed to the sheet receiving unit from the sheet feed device and pushes the sheet to the sheet support plane of the sheet support plate, and a drive device arranged in the main unit outside of the sheet receiving unit, the drive device driving the push device;

wherein the drive device comprises:

a reciprocating rod having a roller pushing the sheet push plate at a top end thereof, the reciprocating rod being arranged so as to normally cross the sheet push a movable base supporting a rear end of the reciprocating rod and moving in a direction normal to the sheet push plane of the sheet push plate;

a plurality of guide shafts slidably connected to the movable base and arranged parallel with the reciprocating rod;

a ball screw arranged parallel with the guide shafts and connected to the movable base so as to have a screw connection therebetween;

a first bevel gear fixed coaxially with the ball screw; and a motor having a second bevel gear fixed on a rotational shaft thereof, the second bevel gear meshing with the first bevel gear.

8. A sheet handling apparatus including:

a main unit;

a sheet validating device for determining whether a sheet received from outside is valid or not, the sheet validating device being provided in the main unit;

a sheet receiving unit which is detachable from the main unit;

a sheet feed device having a feed path to the sheet receiving unit and a plurality of roller pairs arranged at both sides of the feed path, the sheet feed device feeding the sheet which is determined as valid by the sheet validating device to the sheet receiving unit through the roller pairs;

a sheet support plate slidably arranged in the sheet receiving unit, the sheet support plate having a sheet support plane; and a sheet push plate arranged so as to face to the sheet support plane of the sheet support plate, the sheet push plate moving the sheet fed to the sheet receiving unit through the roller pairs in the sheet feed device, toward the sheet support plane while pushing the sheet;

wherein when a rear end of the sheet fed to the sheet receiving unit is held by a roller pair positioned in a final stage among the roller pairs, the sheet push plate draws and separates the rear end of the sheet from the roller pair in the final stage and pushes the sheet to the sheet support plane of the sheet support plate.

9. The sheet handling apparatus according to claim 8, further comprising:

a push device constructed from a parallel crank mechanism connected to the sheet push plate, the parallel crank mechanism rotating the sheet push plate downward while retaining a parallel relation between a sheet push plane of the sheet push plate and the sheet support plane of the sheet support plate.

10. The sheer handling apparatus according to claim 9, wherein the parallel crank mechanism comprises:

a first link with a first end which is rotatably connected to a first rotational center positioned at an upper part of the sheet push plate;

a second link with a first end which is rotatably connected to a second rotational center positioned at a lower part of the sheet push plate;

a first shaft which is connected to a third rotational center positioned at a second end opposite to the first end in the first link, the second end being rotatable around the first shaft; and a second shaft which is connected to a fourth rotational center positioned at a second end opposite to the first end in the second link, the second end being rotatable around the second shaft;

whereby the parallel crank mechanism constructs a quadric chain mechanism.

11. The sheet handling apparatus according to claim 10, wherein a first distance between the first rotational center and the second rotational center equals to a second distance between the third rotational center and the fourth rotational center, wherein a third distance between the first rotational center and the third rotational center equals to a fourth distance between the second rotational center and the fourth rotational center, and wherein a fixed link connecting the third rotational center and the fourth rotational center is arranged substantially parallel with a movement direction of the sheet fed out from the sheet feed device.

* * * * *